United States Patent [19]

Jackson, Sr.

[11] 4,018,540

[45] Apr. 19, 1977

[54] ROAD MAINTENANCE MACHINE

[76] Inventor: James A. Jackson, Sr., 8330 Cantrell Road, Little Rock, Ark. 72207

[22] Filed: Mar. 5, 1974

[21] Appl. No.: 448,404

[52] U.S. Cl. ..... 404/95; 126/271.2 A

[51] Int. Cl.[2] ..... E01C 23/14

[58] Field of Search ..... 404/83, 90, 92, 93, 404/95, 120, 118; 126/343.5 A, 271.2 A

[56] References Cited

UNITED STATES PATENTS

| | | | |
|---|---|---|---|
| 542,349 | 7/1895 | Perkins | 404/95 |
| 637,713 | 11/1899 | De Camp | 404/90 |
| 2,199,884 | 5/1940 | Kennedy | 404/92 |
| 2,254,463 | 9/1941 | Wells et al. | 404/95 |
| 2,747,475 | 5/1956 | West | 404/95 |
| 3,055,280 | 9/1962 | Neville | 126/271.2 A X |
| 3,132,642 | 5/1964 | Fingland | 126/271.2 A |
| 3,221,617 | 12/1965 | Quigg | 404/95 |
| 3,724,445 | 4/1973 | Cutler | 126/271.2 A |
| 3,801,212 | 4/1974 | Cutler | 126/271.2 A |
| 3,874,366 | 4/1975 | Cutler | 126/271.2 A |

*Primary Examiner*—Nile C. Byers

*Attorney, Agent, or Firm*—Hubbard, Thurman, Turner & Tucker

[57] ABSTRACT

A road maintenance machine is provided with a heater assembly mounted on a general purpose chassis which is adapted for selectively attaching various road working devices. The heater assembly includes multiple rows of high temperature burner units each having means for burning fuel and projecting the generated heat downward against the road surface. The rows are spaced apart to allow the top of the surface to partially cool between burner rows as the heat penetrates the pavement in order to maintain the surface temperature below its flash point but high enough to achieve sufficient heat penetration to soften the pavement material to a significant depth. Heat shields and exhaust hoods are provided between the rows of burners to confine and direct the heat and combustion products. The chassis is provided with an adjustable hydraulic mechanism to which an asphalt planer, a scarifier assembly or a grooving cylinder may be attached to work the softened pavement material. An elevator is mounted at the rear of the machine to clear the roadway of planed material. An oscillating screen may be connected to the machine behind the scarifier assembly to smooth the worked surface. Methods are described for asphalt heating, asphalt planing, asphalt scarifying and asphalt grooving using the road maintenance machine.

15 Claims, 25 Drawing Figures

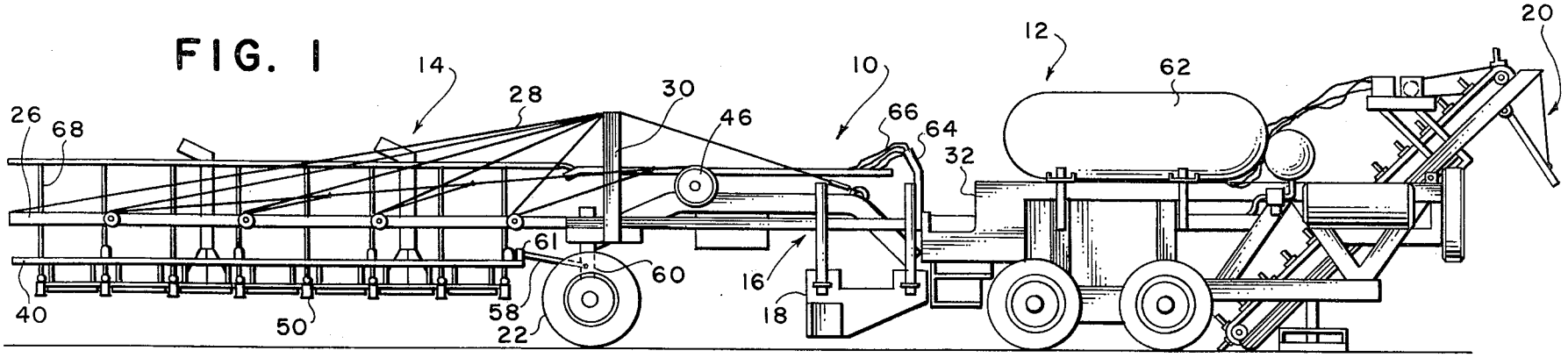
FIG. 1
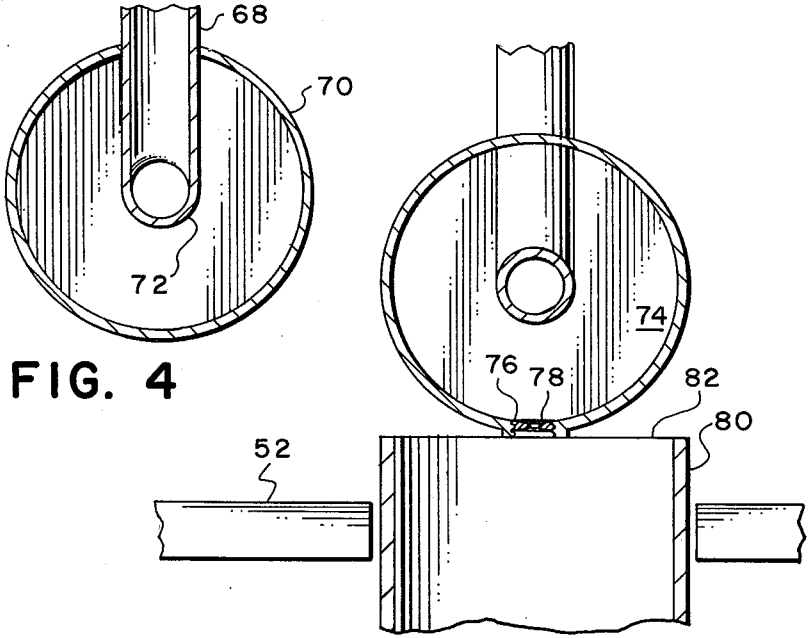
FIG. 4
FIG. 5
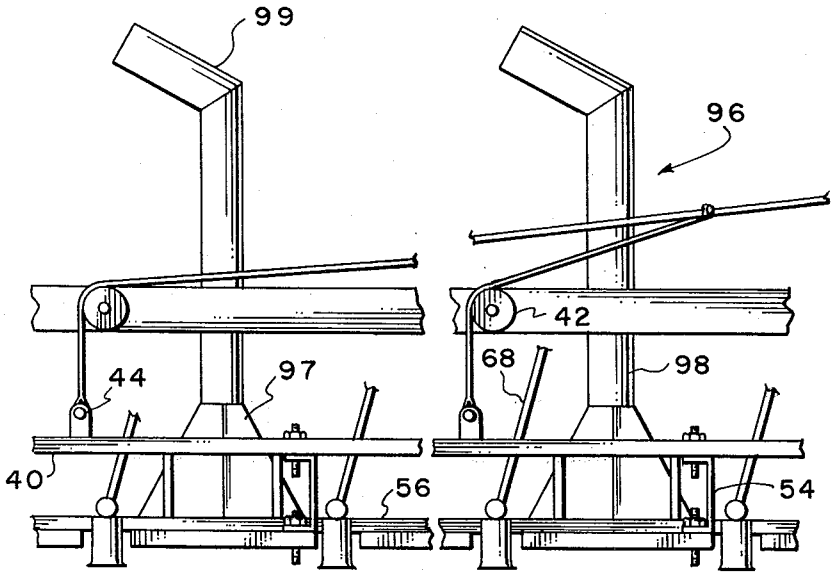
FIG. 2

ROAD MAINTENANCE MACHINE

BACKGROUND OF THE INVENTION

Many modern roadway surfaces are composed of asphalt, macadam or other bituminous covering to form a smooth pavement. Over a period of time, weathering and extensive use of the roadways will render the pavement surface hard and brittle, resulting in irregularities and cracking in the pavement. Shrinkage cracks may develop allowing water penetration to cause further deterioration of the roadway surface. Once started, pavement deterioration increases at an accelerated rate and, unless prompt action is taken, complete reconstruction may be required. The breakdown of pavement structure may be further accelerated by the lack of proper drainage or the presence of corrosive foreign matter, such as chemicals or road salts. Improper construction, such as the use of too little or too much asphaltic binder, an unsatisfactory grade of aggregate or inadequate compaction may cause further pavement deterioration.

In response to these road pavement problems, reconditioning apparatus and equipment have been developed to rework, and, if necessary remove, the weathered pavement. A typical system utilizes heating apparatus to soften the pavement, followed by apparatus to rake or plane the surface. In some cases an additional coating is spread over the reworked surface and the mixture is compressed by compacting equipment.

A basic problem in restoring road surfaces has been heating the pavement surface to a temperature and depth sufficient to permit the surface material to be adequately worked. Intense heat must be applied in order to obtain sufficient heat penetration through the pavement surface because of the low heat conductivity of asphalt. However, intense cannot be applied for a long period since asphalt burns at a relatively low temperature. Such asphalt burning may result in sufficient damage to prevent reuse of the asphalt for resurfacing purposes. Furthermore, smoke from the burning asphalt pollutes the atmosphere.

To overcome this heating problem maintenance machines must frequently make multiple passes over the same section of roadway in order to heat and work the pavement to a sufficient depth. This procedure is inefficient and time-consuming and substantially increases maintenance costs. Other machines use multiple heater units each operating at a temperature below the asphalt burning point. A large number of such units are required to achieve the desired heat penetration, thus adding to the bulkiness and cost of the equipment.

Another basic problem in road maintenance is that the type of reconditioning needed varies greatly with different pavement sections depending upon the original composition, the extent of deterioration and other factors. For example, surfaces having bumps and irregularities as well as minor cracking may be sufficiently restored by heating and planing the surface. Asphalt planing may be the only practical method for treating roadway surfaces in tunnels and on bridges where a specified headroom clearance is required. Other roadways having deep ruts and grooves require more extensive working. It may be necessary to rake or scarify the heated pavement surface and then smooth and resurface the pavement. Moreover, some highway portions require special treatment, such as grooving to prevent automobile skidding.

The great variation in the type of machinery and process required to recondition different roadway sections necessitates the use of a variety of equipment, thus substantially increasing the cost of maintenance. Furthermore, multiple passes of such equipment are frequently needed in order to produce a finished surface of satisfactory smoothness and durability.

SUMMARY OF THE INVENTION

The present invention is directed to road conditioning apparatus and methods for reworking and restoring road surfaces. More particularly, a general purpose roadway maintenance machine is disclosed having the necessary attachments and modifications to provide a variety of resurfacing operations. A burner system is attached to the general purpose maintenance machine for heating and softening the pavement to the necessary temperature and depth without burning or damaging the pavement surface.

In accordance with one aspect of the present invention, the maintenance machine is equipped with a burner assembly having multiple rows of high temperature burner units suspended above the paved surface. Each burner unit directs heat to the pavement surface at a temperature substantially higher than the burning temperature of asphalt. The burner rows are spaced apart from each other along the line of travel of the maintenance machine to allow the pavement surface to partially cool between heat applications as heat penetrates into the pavement. The alternating periods of heating and cooling prevent the pavement surface temperature from exceeding the flash point of the asphalt yet allow penetration of heat to a substantial depth below the surface. The depth of heat penetration desired, the permissible surface temperature and the heat conduction characteristics of the surface material determine the arrangement of the burner assembly. Extra burners may be added to increase the depth of heat penetration. The temperature at the pavement surface may be varied by changing the horizontal spacing between rows of burner units, the vertical distance between burner units and the surface and the velocity of the maintenance machine.

In accordance with another aspect of the present invention, heat shields are provided between the rows of burners to confine the heat from the burners substantially below the burner apparatus. Hoods may be mounted on the heat shields over apertures in the shields to confine and direct the heat and products of combustion upward and away from the maintenance equipment and trees or other objects susceptible to heat and smoke.

In accordance with another aspect of the present invention, the maintenance machine is equipped with an asphalt planer behind the heater elements of the burner system for removing the heated surface material to form a smooth new surface for the roadway. Distortions and irregularities are leveled and high spots are evened out. Excessive bitumen which has risen to the top of the pavement surface due to prolong wear and heat is removed. Oxidized and brittle portions of the pavement are also planed off before resurfacing. The cuttings from the asphalt planer are picked up and loaded by a conveyor elevator attached to the maintenance machine.

In accordance with another aspect of the invention the maintenance apparatus is equipped with a rake or scarifier behind the heating elements of the burner system for reworking the pavement surface preparatory to resurfacing. After the application of an emulsion or rejuvenating agent, a new resurfacing material is applied, followed by compaction. As an alternative, the maintenance machine may be equipped with an oscillating mechanism for smoothing the surface after scarifying.

A further aspect of the present invention utilizes a grooving mechanism attached to the maintenance machine behind the heating elements of the burner system to apply parallel grooves transversely across a portion of roadway in order to give the roadway surface nonskid characteristics.

BRIEF DESCRIPTION OF THE DRAWINGS

For a more complete understanding of the present invention and for further objects and advantages thereof, reference may now be had to the following description taken in conjunction with the accompanying drawings in which:

FIG. 1 is a side elevation of the road maintenance machine of the present invention.

FIG. 2 is a close-up view of a portion of the road maintenance machine of FIG. 1 showing the burner assembly of the present invention.

FIG. 4 is a cross section of the burner assembly of FIG. 3 taken on line 3—3.

FIG. 5 is a cross section of the burner assembly of FIG. 3 taken along line 4—4.

DESCRIPTION OF THE PREFERRED EMBODIMENT

Figure 7:
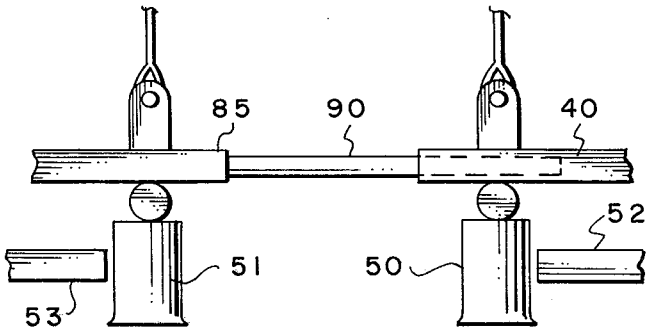
FIG. 7 is a close-up view of a portion of FIG. 6 showing the interconnection of the burner assembly with its extension.

Referring now to FIGS. 1 and 2, a road maintenance machine 10 includes a chassis 12 having a burner assembly 14 attached to the front portion of the chassis. The middle section of the chassis 12 is provided with convertible gear means 16 for the attachment of various devices depending upon the type of maintenance work needed. As shown in FIG. 1, an asphalt planer 18 is attached to gear means 16 in raised position. An elevator 20 is provided at the rear of chassis 12 for removing the planed paving material from the roadway.

Chassis 12 is preferably a modified form of a standard road grading machine, such as caterpillar motor grader model 12. The drive assembly gear ratio has been modified to provide the necessary operating speeds. The conventional front wheels have been replaced with metal front wheels 22 to provide additional weight and durability due to their location in close proximity to the burner assembly. Gear means 16 is the standard gear driven mechanism found on conventional graders. Alternately, an appropriate hydraulically driven system may be provided.

Burner assembly 14 is supported by two chassis booms 26 which project in front of machine 10 parallel to the roadway and connected to chassis 12 by conventional means. Booms 26 are supported by a plurality of tension cables 28 connected at various points along the boom. Cables 28 extend rearwardly over a mast 30 fixed to chassis 12 just behind front wheels 22 and projecting vertically above the chassis. Cables 28 each terminate in an eyelet 34 anchored to chassis 12 in front of chassis cab 32.

Figure 1A:
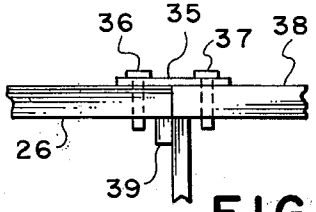
FIG. 1A is a close-up view of a portion of the road maintenance machine shown in FIG. 1.

Booms 26 and burner assembly 14 may be detached from chassis 12 and disassembled for transporting to another work site. As shown in FIG. 1A, each of booms 26 are preferably attached to chassis 12 by a connecting plate 35 having a pin 36 at one end projecting downward into an aperture at the end of the boom nearest the chassis 12. A pin 37 integral with the other end of plate 35 extends vertically down into an aperture in the end of a chassis member 38 at the front of chassis 12. A lower ledge 39 of chassis member 38 juts horizontally out beneath boom 26 to provide vertical support for the booms.

A rectangular framework 40 is horizontally suspended below booms 26 by cables 42 each connected to a bracket 44 integral with framework 40. Cables 42 extend rearwardly to two take-up reels 46 which are attached on either side of chassis 12 behind vertical mast 30. Reels 46 may be rotated by hydraulic controls in cab 32 to raise and lower framework 40 as required.

Burner assembly 14 is provided with multiple rows of burner units 50, perferably having two units per row. Each burner row 50 is suspended parallel to the ground and spaced horizontally apart from the adjacent rows along the direction of travel. A rectangular insulator panel 52 is suspended horizontally between each row of burners by a bracket 54 or other suitable attachment device connected to framework 40. Each burner unit in turn is suspended by attachment to an angle iron subframe 56 interconnecting the insulator panels 52. Framework 40 is supported against horizontal movement by two bars 58 rotatably mounted between a front axle member 60 of chassis 12 and brackets 61 on the rear portion of framework 40.

Fuel for the burner assembly 14 is supplied under pressure from two large tanks 62 mounted above chassis 12 behind cab 32. Each tank is connected to a common high pressure distribution manifold 64 via a high pressure hose through a main snap valve (not shown) that can shut off all gas flow. The fuel is distributed to each burner unit 50 by a hose 66 running from distribution manifold 64 along the center of chassis 12 and burner assembly 14 to connect to feeder pipes 68. A preferred embodiment employs two 500 gallon liquid petroleum gas tanks connected to a common high pressure manifold with high pressure LPG hose rated at a 150 pounds per square inch. The burner assembly has eight rows of burners, and the manifold has sixteen outlets, one for each row, making it possible to add eight additonal rows of burning units when needed. The basic manifold is normally equipped with schedule 80 piping and eight regulators, pressure gauges and snap valves for independent control of each row of burners.

Figure 3:
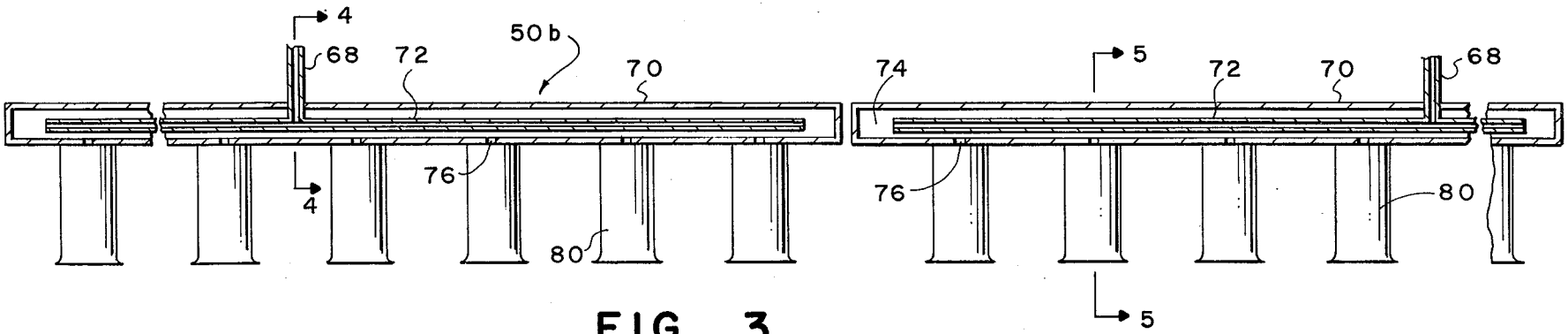
FIG. 3 is a front partial view of the burner assembly of FIG. 2.

With reference to FIG. 3, a cross section is shown of one row of burners 50 disclosing two burner units 50*a* and 50*b*. Each unit includes an outer tubing 70, forming a cylindrical mixing chamber 74 for vaporizing the liquid fuel. As best shown in FIG. 4, feeder pipe 68 passes through an opening in tubing 70 at about the center of the chamber 24 connecting to a distributor tube 72 extending perpendicular to pipe 68 substantially the full length of outer tubing 70. Distributor tube 72 is open at either end to provide inlets for the fuel to enter the mixing chamber 74. Outer tubing 70 is provided with orifices 76 spaced at even intervals along the lower length of tubing 70.

As seen in FIG. 5, each orifice 76 is fitted with a conventional needle valve 78 for feeding an even flow of fuel out of the orifice. High temperature combustion of the fuel occurs in multiple burner cylinders 80. Each cylinder 80 is vertically attached to outer tubing 70 directly below each orifice 76 and projects downward with a slight outward flare at the lower end, having a diameter approximately the same as the diameter of tubing 70. The open upper end of cylinders 80 provide passageways 82 on either side of tubing 70 to draw air into the burner cylinders 80 for mixing with the fuel vapors to enhance fuel burning. The lower end of cylinders 80 are also open to direct the heat and products of combustion downward onto the pavement surface. Burner cylinders 80 and orifices 76 are apaced along the tubing 70 such that the heat projected downward by cylinders 80 completely covers a strip of pavement along the entire length of each burner unit. In a preferred embodiment of the burner units, the outer tubing of the mixing chamber is two inches in diameter and four feet long, having eight orifices spaced at 6 inch intervals. The burner cylinders are each 2 inches in diameter and four inches long. Each burner unit burns a maximum of 8 gallons per hour, producing an operating temperature of 1600° to 2000° Fahrenheit.

An important feature of the burner assembly is the use of spaced multiple rows of burner units 50 as best seen in FIG. 2. Each burner row 50 is spaced sufficiently apart from the next burner row 50 so that the accumulative effect of the high temperature heat emitted by the burner cylinders 80 will not raise the asphalt temperature above its burning point, normally about 250° Fahrenheit. The pavement surface is alternately heated and allowed to partially cool as each row of burner units 50 pass by. This process allows a low temperature heat to penetrate deeply into the asphalt pavement without damaging the surface material. The number of burner rows used is flexible depending on the depth of heating required and the heat gradient of the road material.

Another important feature of the burner assembly is shown in FIG. 2. The rectangular insulator panels 52 are mounted to frame 40 by brackets 54 and interconnected by subframe 56 and are disposed horizontally between two rows of burner units 50. The width of insulator panels 52 may vary but is preferably wide enough to abut the burner cylinders 80 on either side of panel 52 thereby conserving fuel and shielding the burner units 50 and the external environment from extreme heat.

Exhaust hoods 96 are each mounted on one of the insulator panels 52, over an opening in the corresponding panel 52. Each hood 96 has an inverted cone-shaped portion 97 extending upward from insulator panel 52 and connecting at its upper narrow end to a vertical pipe portion 98 which terminates in an angled pipe portion 99. Each exhaust hood 96 is preferably made of a fireproof material such as asbestos. The angled portion 99 is constructed to direct heat and products of combustion generated beneath insulator panels 52 away from the maintenance apparatus and any external areas which should be protected. If necessary, the hood may be cooled with a water spray.

Figure 6:
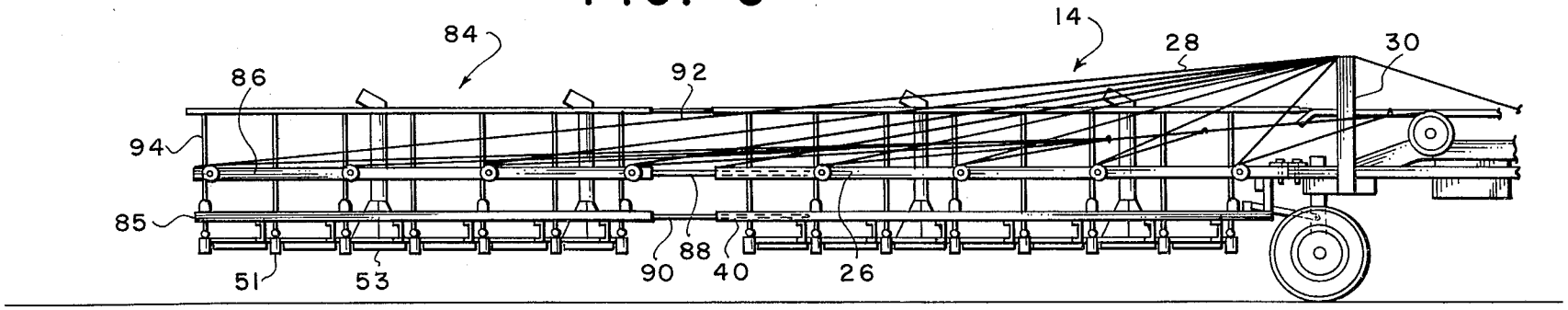
FIG. 6 is a partial side elevation showing an extension to the burner assembly of the present invention.

With reference to FIGS. 6 and 7, a burner extension assembly 84 is shown, having additional rows of burner units 51 and insulator panels 53 mounted on an extension framework 85 in a manner substantially the same as that of burner assembly 14. Boom extensions 86 are provided each having a reduced diameter portion 88 which will extend into a chassis boom 26. A similar extension portion 90 projects from framework 85 to connect into framework 40. Extension cables 92 are connected at suitable points on boom extensions 86 and project rearwardly over vertical mast 40 and anchor to chassis 12. Burner units 51 may be raised and lowered in a manner similar to that of burner units 50 through bracket-cable-pulley combinations 94 substantially identical to that shown for burner assembly 14.

Figure 8:
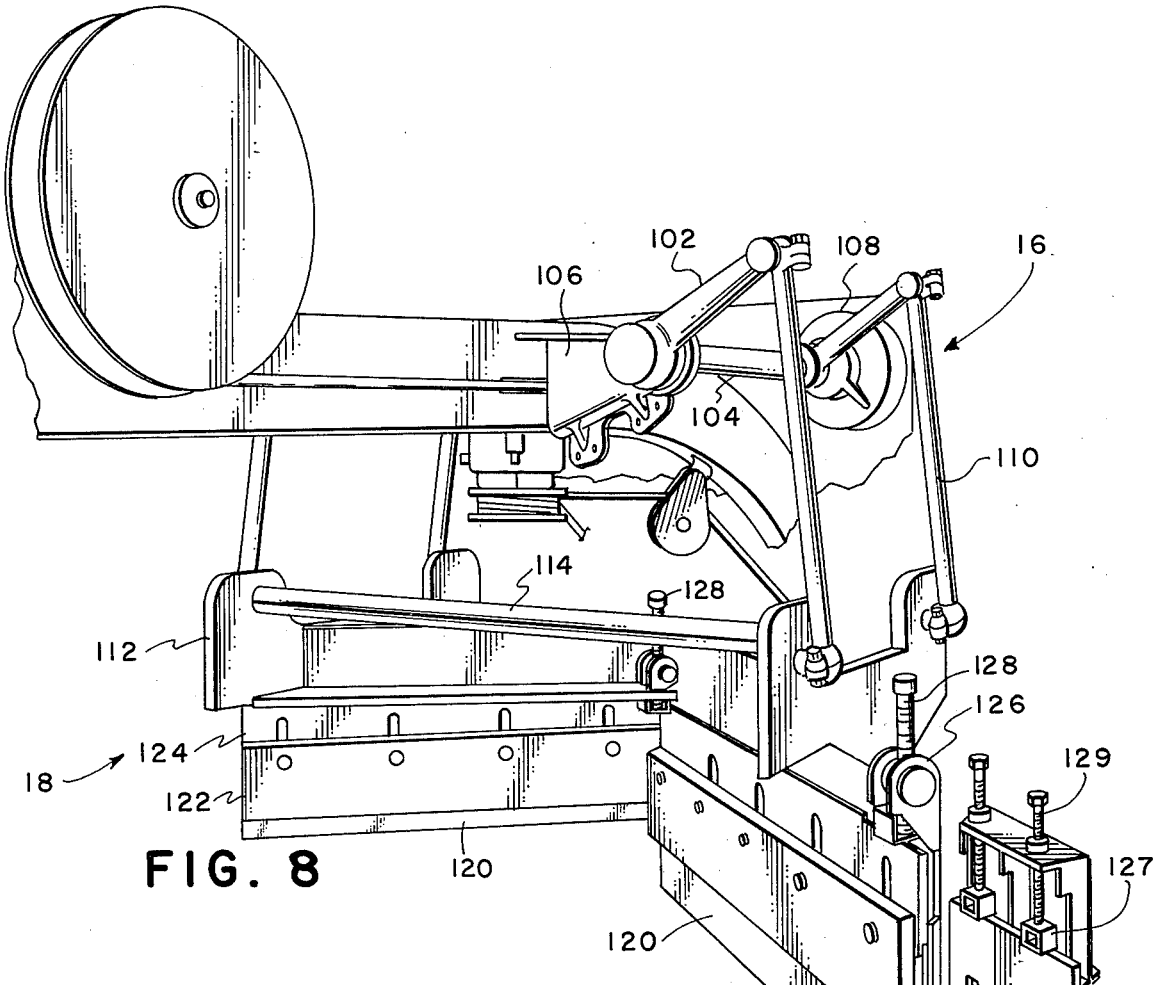
FIG. 8 is a perspective view of the asphalt planer assembly of the present invention.
Figure 9:
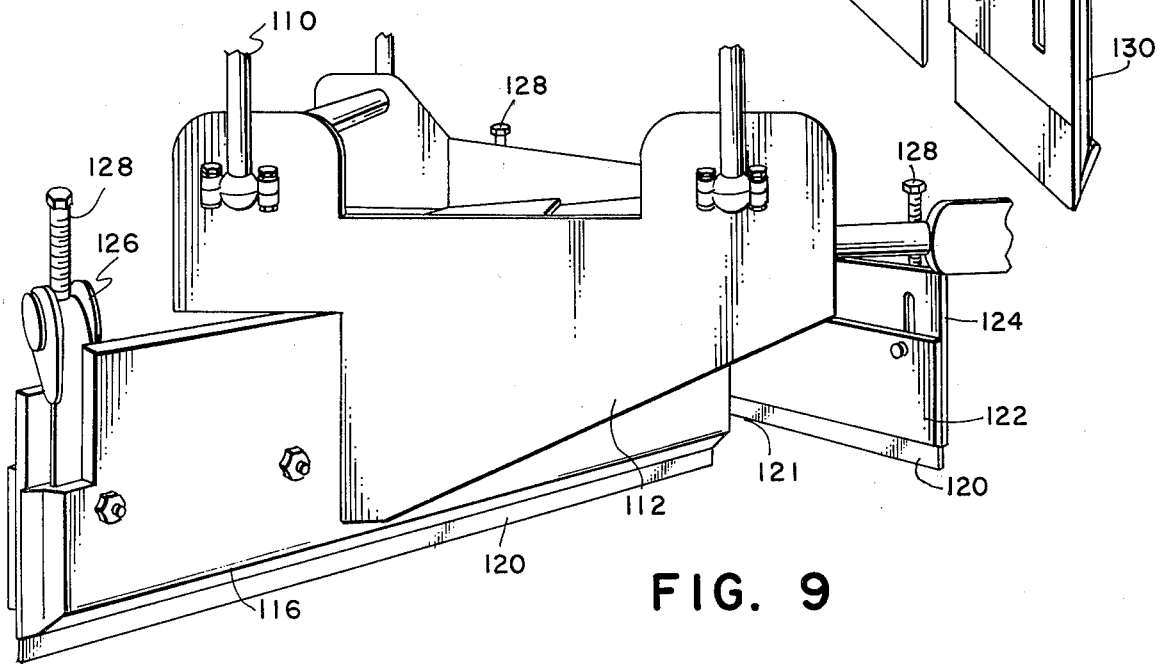
FIG. 9 is a side view of the asphalt planer shown in FIG. 8.

FIGS. 8 and 9 show in more detail the asphalt planer 18 and the gear means 16 for operating the planer. Two lever arms 102 are attached on each side of the chassis 12. The lever arms 102 are mounted on a horizontal shaft 104 supported between chassis bracket 106 and gear drive 108. A lift arm 110 is connected to the outer end of each lever arm 102. Lift arms 110 on each side of the chassis extend downward to attach to a common moldboard plate 112. Plates 112 are disposed vertically below chassis 12 and are connected by a rod 114 attached between the upper portions of plates 112. Moldboards 116 are integral with plates 112 and extend vertically below the plates in a V-shaped angle with respect to each other. Moldboards 116 have adjacent overlapping ends which are spaced apart to provide an opening 121 at the rearward apex of the V-shaped angle in order to form a windrow of the planed material along the approximate center of the machine 10. A cutting blade 120 is adjustably provided on each moldboard 116 and is secured in position by a cover plate 122. An adjustment plate 124 is secured between the cover plate 122 and moldboard 116 directly above cutting blade 120. Adjustment brackets 126, each having an adjusting screw 128, are attached to the upper edge of adjustment plate 124 to provide for a vertical adjustment of the cutting blade 120 when cover plate 122 is loosened.

An outboard extension 130 is provided at the outer end of each moldboard 116. A supplemental cutting blade 132 attached to the lower part of extension 130 adds extra cutting width to each cutting blade 120. An adjustment plate 125, adjustment brackets 127 and screws 129 provide for vertical positioning of supplemental cutting blade 132 in the same manner as for blade 120. A similar extension 130 may be added to the other moldboard 116 in order to provide for uniform cutting width for both moldboards and extensions.

In a preferred embodiment, moldboards 116 are positioned at an angle approximately 90° relative to each other. The blades have self-sharpening cutting edges made from Jones Laughlin Jalloy steel or the equivalent. Each blade is 68 inches long by 9 inches wide by ½inch thick, and together the two blades provide an 8 foot cutting swath. The 17 inch long moldboard extensions are of similar material and increase the cutting width on each moldboard by 12 inches.

Figure 10:
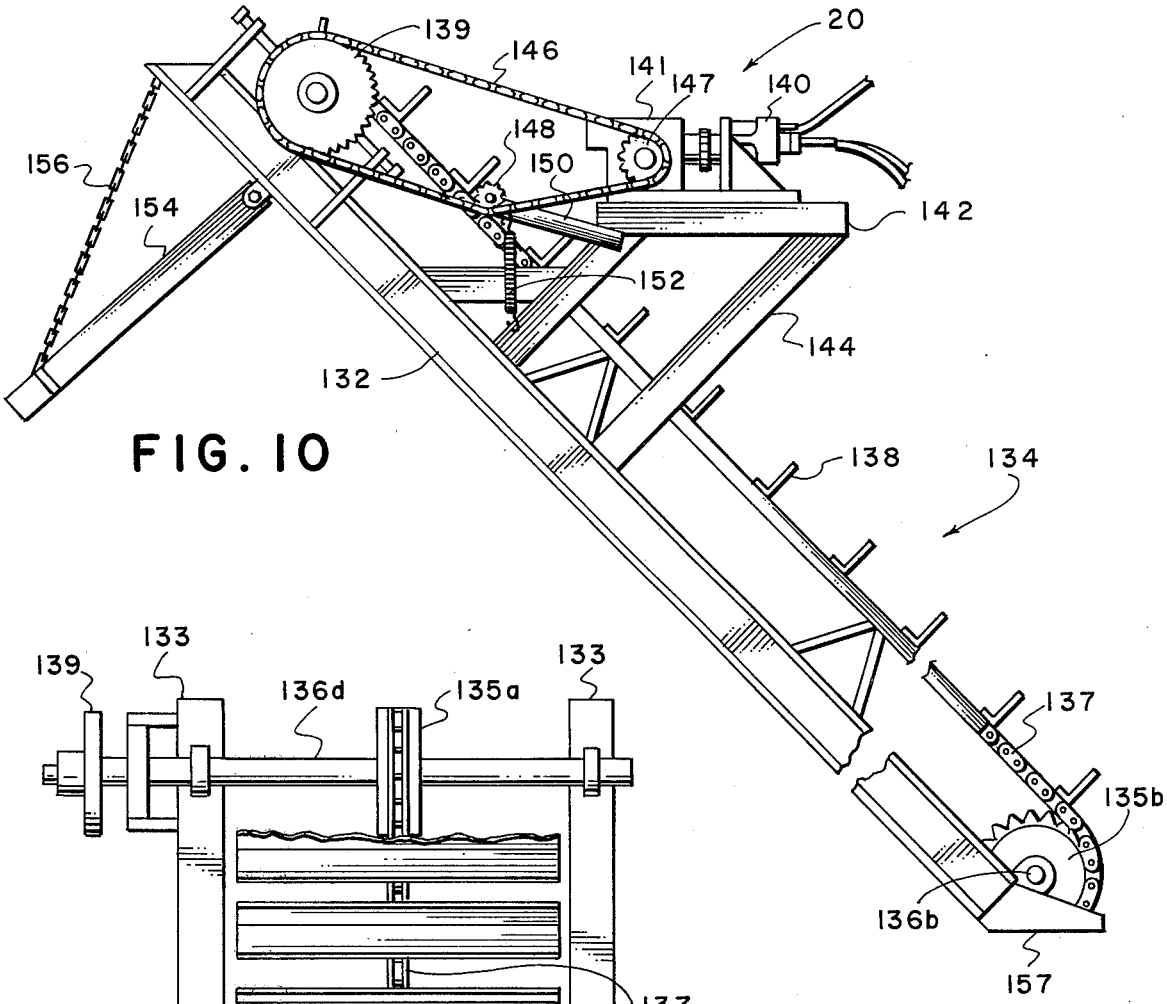
FIG. 10 shows a side view of the elevator assembly of the present invention.
Figure 11:
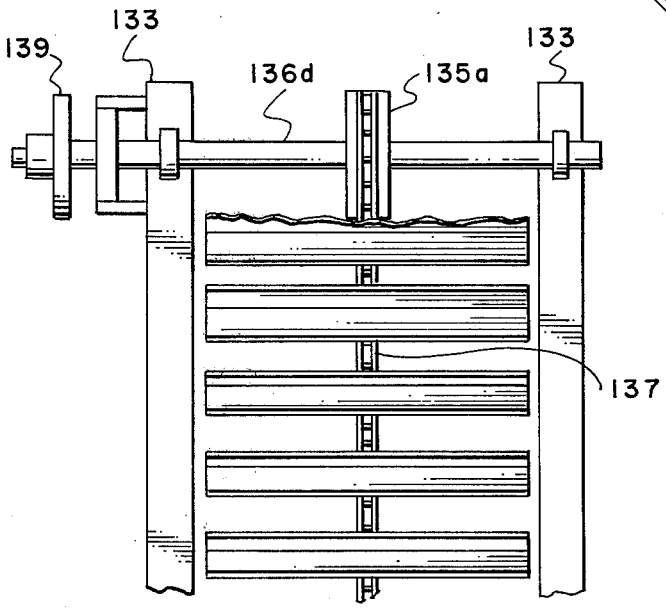
FIG. 11 is a partial top view of the elevator shown in FIG. 10.

With reference to FIGS. 10 and 11, elevator 20 is attached to the rear end of chassis 12 at an angle of about 45° relative to the pavement. A main frame 132 includes two spaced-apart support beams 133 with a conveyor 134 running between. An upper sprocket 135*a* is mounted on a shaft 136*d* secured between support beams 133 at the approximate center of shaft 136*d*. A similar lower sprocket 135*b* is centered on a shaft 136*b* fixed at the lower ends of beams 133. A single conveyer chain 137 runs between the upper and lower sprockets 135*a* and 135*b*. Paddles 138 are affixed to the conveyer chain 137 at spaced intervals to form projecting lifts. A hydraulic motor 140 and a gear box 141 driven by motor 140 are mounted above the conveyer 134 on a horizontal platform 142 by braces 144 extending from each of the beams 133. A drive chain 146 connects a drive sprocket 147 on gear box 141 to an outboard sprocket 139 mounted on shaft 136*d*. A tension sprocket 148 rides on chain 146 and is carried on brace 150 which is biased downward by spring 152 to maintain proper tension in the drive chain 146. An elevator extension panel 154 projects downward at about 90° from the upper portion of beams 133 to direct the elevated materials into a proper receptacle. A pair of chains 156 are attached to the outer end of elevator extension panel 154, providing support and vertical adjustment of extension 154 as needed.

A conveyer shoe 157 attached to the lower end of beams 133 normally rides on the planed surface of the asphalt pavement to pick up all windrowed material from the asphalt planer 18. When the conveyer is not in operation, shoe 157 is raised from the road surface by a cable (not shown) which is controlled from chassis cab 32. A diesel fuel spray pump and tank (not shown) may be utilized to spray a fine mist of diesel fuel over paddles 138 to prevent accumulation of asphalt. A protective shield may be used to cover the lower portion of the conveyer 134 to confine the diesel spray and to shield the engine radiator from the heated asphalt.

In a preferred embodiment conveyer 134 is 16 feet long and mounted at about a 45° angle relative to the pavement. Thirty steel conveyer paddles 19¾ inches long by four inches wide by ¼ inch thick are spaced at 12 inch intervals along a number 160 roller chain having 2 inch pitch. The conveyer shoe is made of one inch thick high carbon steel wearing plate and is replaceable. A Rivinius power take-off attached to a model 12 engine drives a Dennison hydraulic pump through a two-way valve to a Dennison hydraulic motor connected to a Hewitt Robbins gear box. Driving sprocket 147 is geared down to ninety revolutions per minute driving the 30 foot conveyer chain 137 at a speed of 3 revolutions per minute.

Figure 12:
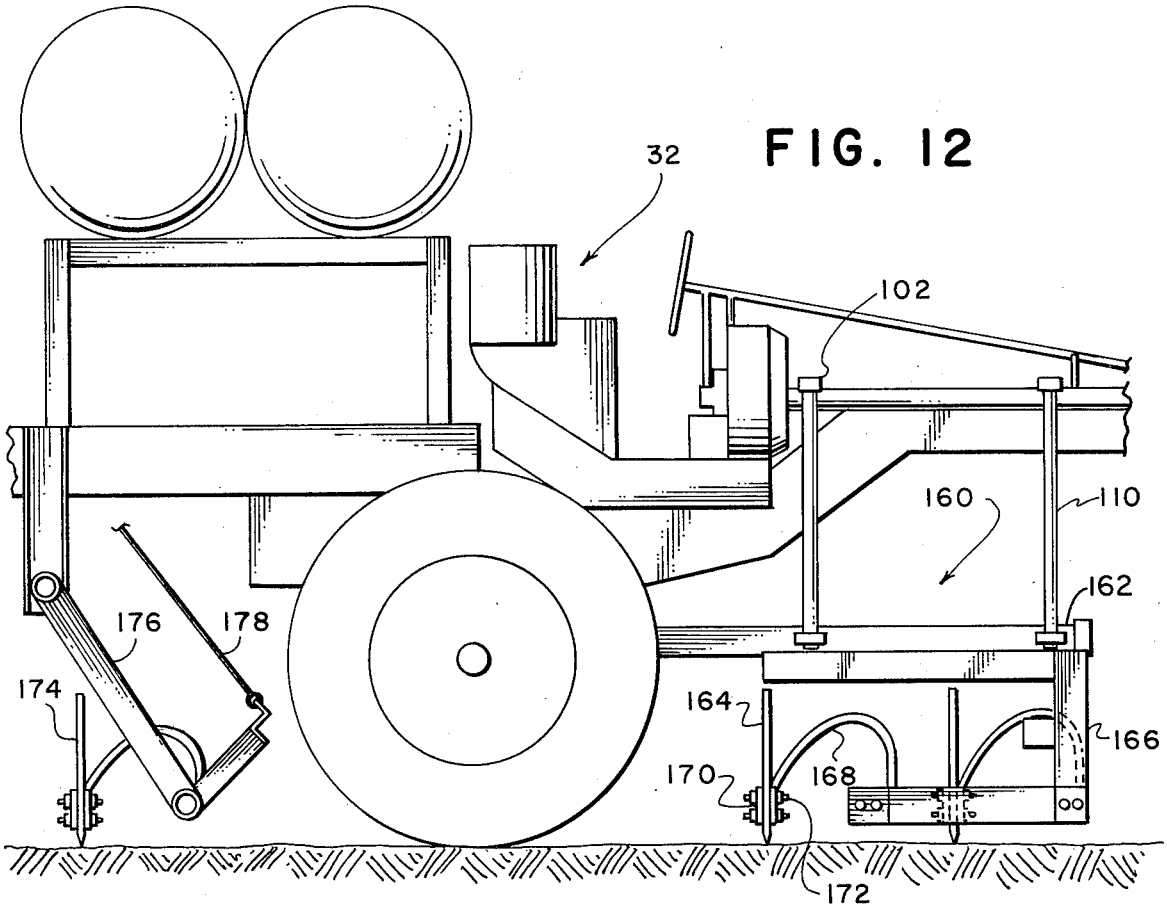
FIG. 12 is a partial side elevation of the maintenance machine of FIG. 1 showing the scarifier attachments of the present invention.
Figure 13:
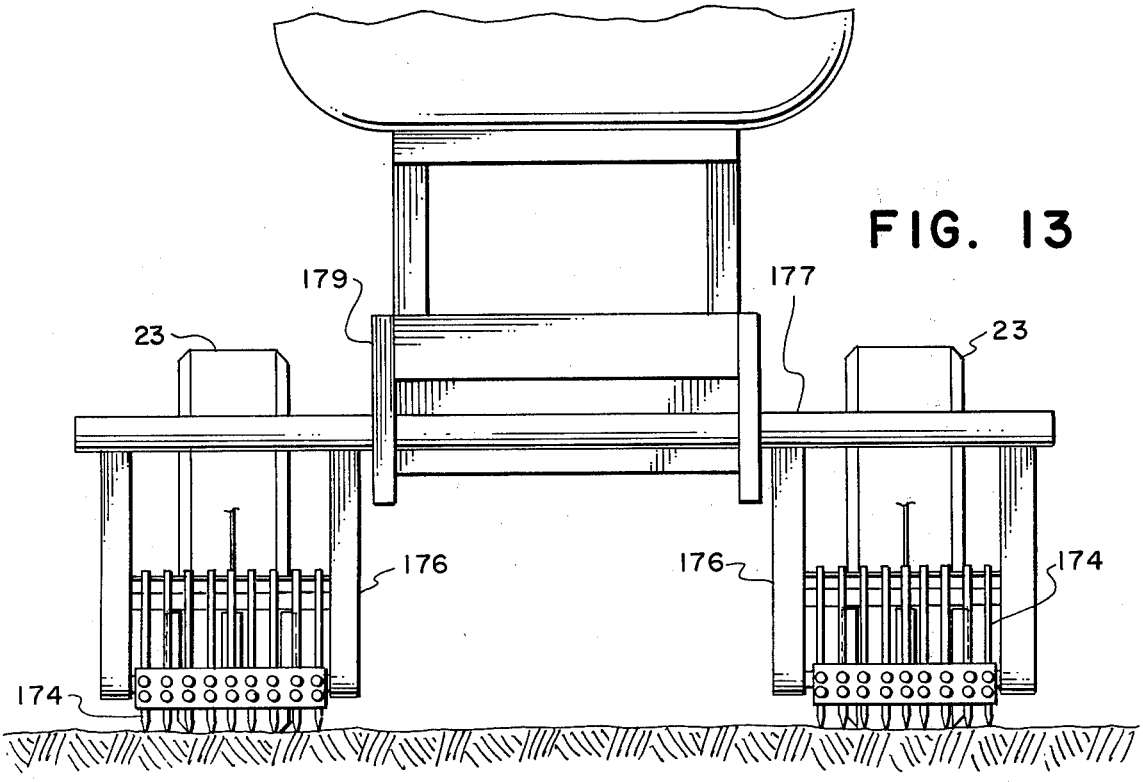
FIG. 13 is a partial rear view showing the rear portion of the scarifier assembly of FIG. 12.

FIGS. 12 and 13 disclose a scarifier assembly 160 which may be attached to gear means 16 in place of asphalt planer 18. A scarifier framework 162, connected to the lift arms 110, is disposed horizontal to the ground and extends underneath chassis 12 above the pavement area previously covered by burner assembly 14. Two rows of scarifier teeth 164 are mounted on a subframe 166 attached to scarifier framework 162. A heavy duty spring 168 is provided to connect each tooth 164 to subframe 166 and to bias tooth 164 downward against the pavement. Spring 168 and tooth 164 are connected together by a plate 170 and nuts and bolts 172 so that they can be adjusted for wear. Two separate near scarifier units 174 are provided with mounting arms 176 which are attached to chassis 12 behind rear wheel 23. A support bar 177 is attached by a pair of brackets 179 to chassis 12. Support bar 177 extends across the entire width of chassis 12 behind wheels 23 to connect to mounting arms 176. A cable 178 is provided at the front of mounting arms 176 to allow each rear scarifier unit to be raised and lowered as needed. Each row of front scarifiers 164 is ideally operated independent of the other rows to insure uniform scarification regardless of the pavement cross section. Scarifier extensions may be added on the outboard side of each front of the scarifier row as desired. Likewise additional rows of teeth may be added or alternatively the density of teeth in each row may be increased.

A preferred embodiment of the scarifier assembly is provided with two rows of teeth, each being eight feet wide. The scarifier teeth are 18 inches long, having a ⅝ inch by ⅞ inch diamond cross section and are disposed on two inch centers. Successive rows of teeth are offset to provide one inch groove spacing over the full width of the scarifier unit. The rear scarifier units utilize similar 18 inch teeth and are approximately 12 inches wide. Scarifier extensions are normally added in 12 inch sections with a maximum suggested width of the total scarifier unit being 16 feet.

Figure 14:
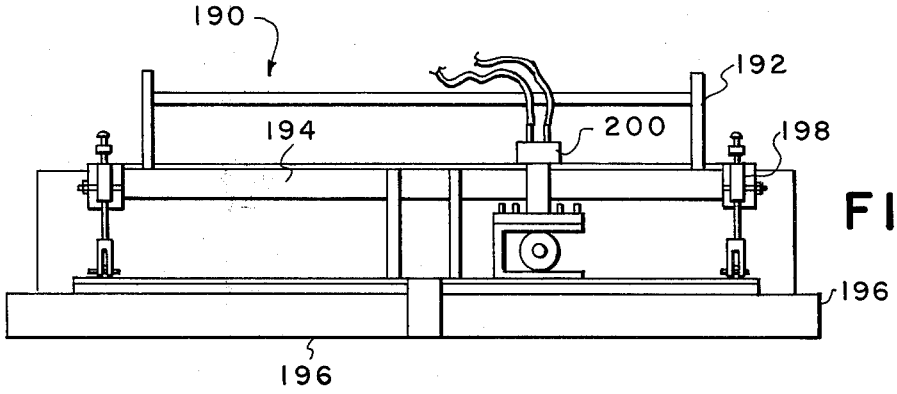
FIG. 14 is a simplified rear view of the oscillating screed of the present invention.
Figure 15:
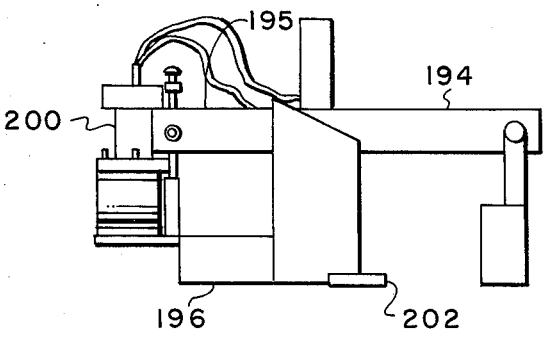
FIG. 15 is a simplified side view of the screed of FIG. 14.

Referring now to FIGS. 14 and 15 a simplified sketch of an oscillating screed 190 is shown. The screed is attached to the rear of chassis 12 to be used in conjunction with front scarifier assembly 160. A screed support 192 is mounted directly to the chassis 12 and extends transversely behind elevator 20 substantially over the pavement portion which has been worked by the scarifier assembly. Bar frame 194 is attached horizontally below support 192 and includes bar extensions 195 projecting rearward normal to bar frame 194 and parallel to the pavement surface. Screed boxes 196 are attached by connectors 198 to the rear ends of bars 195 and extend transversely across the worked portion of the pavement. A hydraulic motor 200 is mounted on the screed boxes 196 being driven by a hydraulic pump (not shown). Motor 200 may be the same as conveyer motor 140 since elevator 20 is not normally in use when oscillating screed 190 is in operation. Motor 200 drives a reciprocating bar 202 connected along the front of screed boxes 196 to smooth out the scarified pavement. Typically, bar 202 is a sawtoothed blade type which reciprocates horizontally in 4 inch oscillations transverse to the direction of travel. A conventional heater mechanism (not shown) may be utilized to warm screed boxes 196 in order to improve performance. The heaters are supplied by the fuel system which furnishes fuel to burner assembly 14.

Figure 16:
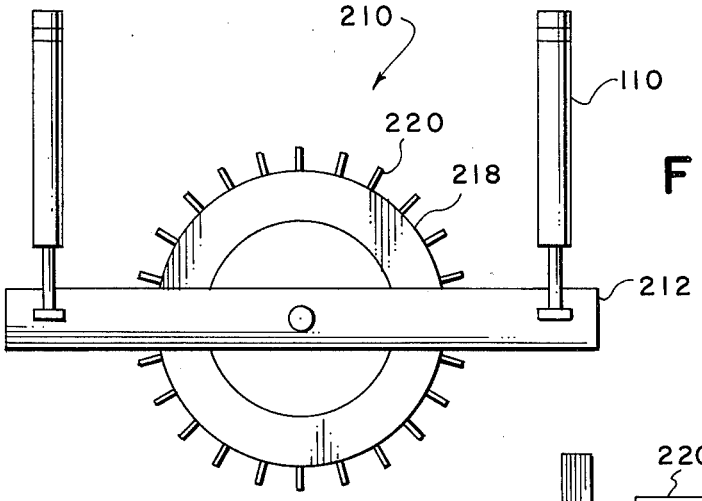
FIG. 16 is a side elevation view of the grooving attachment for the present invention.
Figure 17:
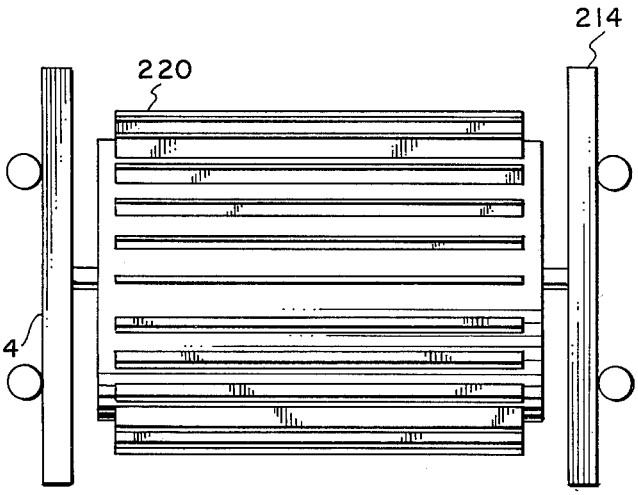
FIG. 17 is a top view of the grooving attachment of FIG. 16.

FIGS. 16 and 17 disclose a grooving attachment 210 which may be connected to gear means 16 in place of asphalt planer 18 or scarifier assembler 160. Groover frame 212 is connected to lift arms 110 by a pair of horizontally disposed support members 214 on either side of chassis 12. An axle 216 runs between members 214 and carries a grooving cylinder 218. Radial fins 220 extend substantially across the length of cylinder 218 and project perpendicular to the surface of the cylinder. The fins are spaced at even intervals around the circumference of cylinder 218, preferably 3 to 4 inches appart to provide for a regular non-skid grooving pattern in the pavement.

Figure 18:
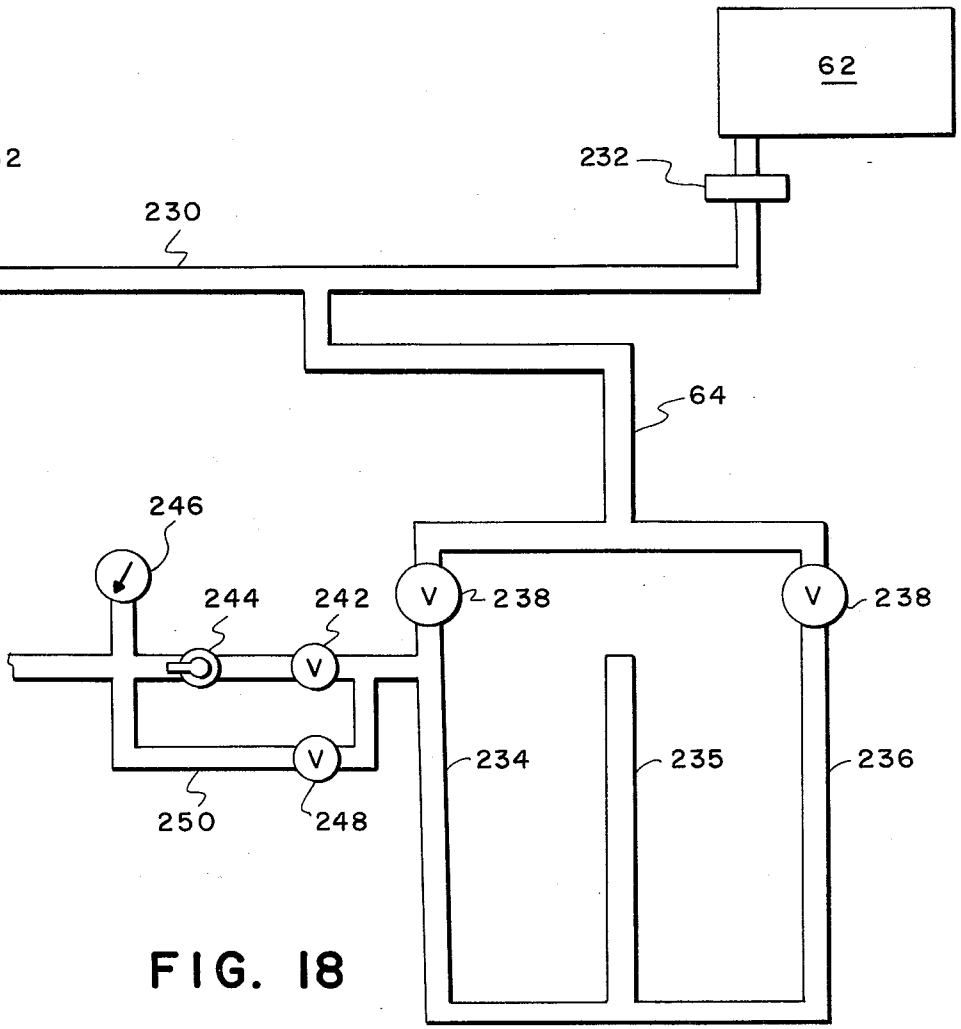
FIG. 18 is a schematic flow diagram of part of the fuel supply system of the invention.
Figure 19:
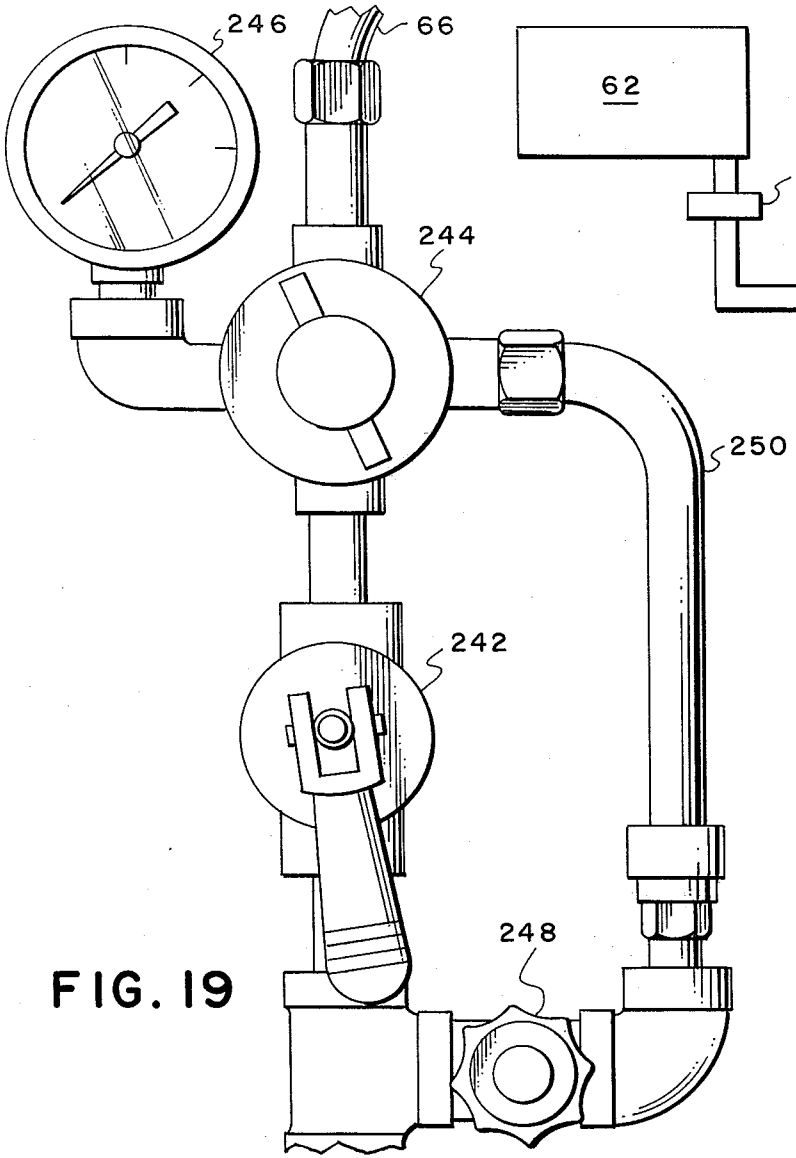
FIG. 19 is a front view of one of the regulation mechanisms of the fuel system depicted in FIG. 18.

FIGS. 18 and 19 disclose the fuel supply system in greater detail. The fuel from tanks 62 is directed through high pressure hose 230 and strainers 232 to manifold 64 which divides into three feeder branches 234, 235, and 236. Two check valves 238 are provided to cut off all fuel flow to the feeder branches.

As previously mentioned separate fuel hoses 66 direct fuel to each of the burner units from feeder branches 234–236. For simplicity only one feeder hose branch is shown. Each hose has a separate snap valve 242 to control the supply of fuel to its respective row of burner units 50. A pressure regulator 244 is provided in each fuel hose line downstream from valve 242 to maintain proper pressure, which is displayed by a gauge 246. A needle valve 248 is provided in a secondary fuel line 250 which by passes valve 242 and regulator 244 to supply enough fuel at all times for pilot burners (not shown) in each row of burner units 50.

In operation, the burner assembly 14 is suspended from boom members 26 which are connected to chassis 12. The proper working attachments are connected to hydraulic means 16 and chassis 12, and the conveyer shoe 157 is raised or lowered as needed. Check valves 238 are opened admitting fuel to distributor manifold 64 and through needle valves 248 and secondary lines 250 to pilot burners (not shown) via high pressure hose 66. After the pilot burners are lit, snap valves 244 are opened to admit fuel to burner units 50. The fuel pressure for each pressure hose 66 is monitored and regulated using gauge 246 and pressure regulator 244.

The maintenance machine 10 is then moved along the paved surface to be worked at a predetermined constant speed to heat the pavement surface to the desired depth and temperature. The road surface is heated in successive strips of pavement surface transverse to the line of travel of machine 10. Each strip is rapidly heated as a row of burner units 50 passes over. Between burner rows the insulator panels 52 conserve heat and protect burner units 50 and the surrounding environment by substantially confining the generated heat below the panels 52 near the pavement surface. Exhaust hoods 96 direct excess heat and products of combustion upward and away from the machine 10 and vulnerable objects along the side of the roadway.

By the time the next row of burner units 50 has reached a previously heated strip of pavement, it has partially cooled while maintaining a sufficiently high temperature to promote heat penetration through the pavement surface. The next burner row again briefly applies high temperature heat to the strip of road surface to raise the temperature of the surface and enhance heat penetration.

This heating process is repeated as each row of burner units 50 passes over each successive pavement strip until the entire paved surface has been softened to the depth needed. Sufficient rows of burner units 50 are preferably attached to achieve the desired pavement heating in one pass of machine 10.

A preferred embodiment employs fuel tanks totaling 1,000 gallons maintaining pressure to the burners at 30 pounds per square inch. The burner assembly burns from 125 to 600 gallons per hour at a temperature from 1650° to 2000° Fahrenheit, depending upon the number of burners necessary for the type of method being performed. The rows of burner units are spaced 30 inches apart and between seven to nine inches from the pavement surface. The maintenance machine moves at a speed of 35 feet per minute maintaining the surface below the burner units at a temperature of about 225° Fahrenheit while heating the pavement to a depth of ½ to ¾ inch.

Figure 20:
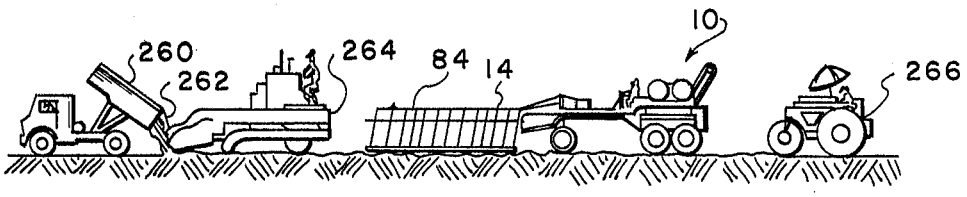
FIG. 20 is a graphic depiction of the asphalt heating method of the present invention.

Referring to FIGS. 20–24, the various methods for utilizing the general purpose road maintenance machine 10 are shown. A method for converting a bleeding, slick asphalt surface to a non-skid surface is illustrated in FIG. 20. A dump truck 260 dumps a load of dry chip material 262, preferably crushed aggregate, into a chip spreader 264 which spreads the chip material uniformly over the surface of the roadway. Burner assembly 14 of the present invention and if necessary burner extension assembly 84, heat the chips and the surface together to the desired depth, usually about ¾ inch. Neither the front scarifier assembly 160 nor the rear scarifier units 174 are used. Finally, a compaction machine 266 follows the maintenance machine 10, pressing the crushed rock into the heated surface to provide a refinished non-skid road surface. This method is useful in situations where the pavement surface has become slick, particularly when wet, becuase of excessive bitumen bleeding to the surface due to heavy use and heat. The addition of the crushed stone both counteracts the excess bitumen and also provides a roughened surface.

Figure 23:
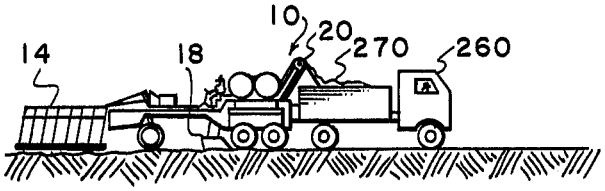
FIG. 23 is a graphic depiction of the asphalt planing method of the present invention.

As an alternative to the above method, FIG. 23 discloses a method of asphalt planing. This process may be used when the surface of the existing pavement has deteriorated to the point of not being reusable, for example because of excessive oxidization or bitumen content. Asphalt planing may be the only practical possibility in situations requiring a specified overhead clearance, such as on bridges or in tunnels. The pavement surface is first softened using burner assembly 14 to heat the existing asphalt surface to a depth of about ¼ inch. The asphalt planer 18 which has been mounted in place of scarifier assembly 160 is used to shear off the heated material leavng a smooth, even surface. Elevator 20 then picks up and transfers the planed off asphalt 270 to dump truck 260 being towed backwards by machine 10. The asphalt planer 18 is designed to enable cutting the roadway flush to all curbs, inlets and manholes and other similar obstructions within the paved area. Although it is normally necessary to make only one pass using the planer attachment, sufficient cuts should be made so that all irregularities of high spots are eliminated. If the pavement is to be resurfaced, a shoulder is normally cut along the gutter line to obviate the necessity of feathering the edge of the new surface. Refinising of the surface is optional depending upon the degree of planing and the type of surface needed.

Figure 21:
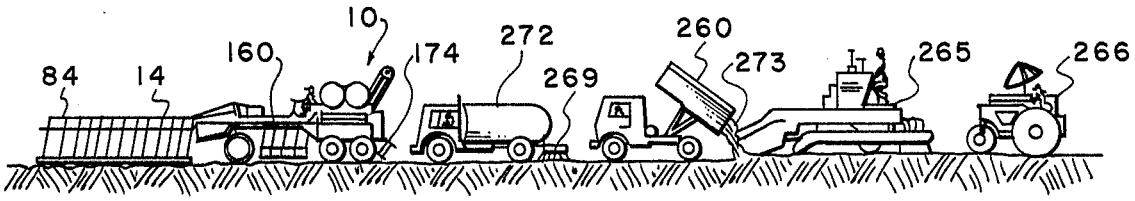
FIG. 21 graphically shows the asphalt scarifying method of the present invention.

In situations where the existing surface is reusable but substantial resurfacing is required, the asphalt scarifying method shown in FIG. 21 is used. The existing surface is softened with heat by burner assembly 14. Burner extension assembly 84 is normally attached since the heating depth in the pavement should reach ½ to ¾ inch. After the pavement is thoroughly heated, scarifier unit 160 and rear scarifier units 174 thoroughly rake and mix the pavement surface to the heated depth to prepare the surface for paving. The reworked paving material 268 is then tacked with an emulsion or rejuvenating agent 269 which is normally spread by tanker truck 272 in the amount of 0.10 to 0.15 gallons per square yard. Next, the dump truck 260 transfers a mixture of surfacing material 273 into a paving machine 265 to spread a new surface on the roadway. The final step is compaction with a roller machine 266.

This process of compacting new material together with heated and worked existing paving material results in a new homogeneous pavement surface having excellent cohesion characteristics. The newly laid aggregate material becomes integral with the preexisting surface and minimizes a disjuncture at the point of resurfacing. The absence of a fissure between the two layers of surfacing eliminates the possibility of moisture spreading through undersurface cracks and causing rapid deterioration in the pavement. This process also makes it possible to utilize all existing surface materials to best advantage.

In a preferred method, the surface is heated and scarified to a depth of ¾ inch. A rejuvenating agent complying with the Asphalt Institute designations SS-2 is applied at a rate of 0.1 gallon per square yard and a layer from ¾ inch to one inch of asphalt mix is spread by a mechanical spreader providing a layer from 75 to 100 pounds per square yard. Compaction is achieved using a Tandom steel roller resulting in a new surface which is homogeneously bonded or welded to the existing scarified surface of the pavement.

Figure 22:
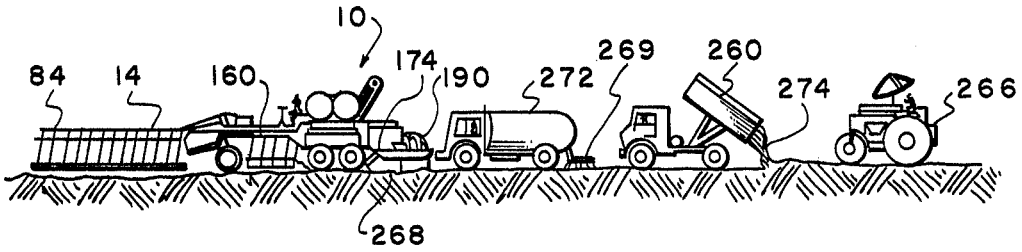
FIG. 22 is a graphic depiction of the asphalt scarifying method utilizing an oscillating screed.

A variation of the previously discussed asphalt scarifying method using an oscillating screed is shown in FIG. 22. This process may be used where the pavement is somewhat distorted, cracked or oxidized but where usage does not warrant resurfacing. The surface is first heated and raked and the reworked material 268 is passed through an oscillating screed 190 attached to the rear of machine 10. As with the asphalt scarifying method, the pavement is heated by burner assembly 14, preferably also utilizing burner extension assembly 84. Scarifiers 160 and 174 rake and mix the heated surface which then passes through oscillating screed 190. Screed 190 smoothes out the pavement surface and provides initial compaction. A rejuvenating agent 269 is then spread by tanker truck 272, or as an alternative a fine silicious mixture 274, such as sand, is spread by dump truck 260, depending on the bitumen content of the pavement. As a final step, compaction by roller 266 finishes the pavement surface.

Figure 24:
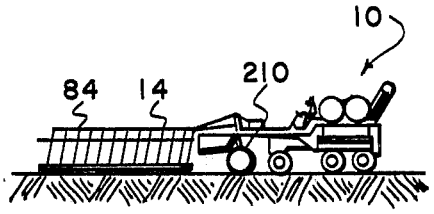
FIG. 24 depicts graphically the asphalt grooving method of the present invention.

FIG. 24 shows the asphalt grooving process of the present invention. The pavement surface is first heated to a depth of about ½ inch using burner assembly 14 and if necessary, burner extension assembly 84. Grooving attachment 210 is then rolled over the softened surface leaving parallel transverse grooves along the pavement. In one application the grooves where ⅜ inch wide and ⅜ inch deep and were three inches apart, 96 inches across the pavement. The grooving process is normally used when a surface highly resistant to skidding is desired. In some cases where the pavement has become slick, the asphalt grooving method may be used as an alternative to the asphalt heating and asphalt planing processes already mentioned.

Having described the invention in connection with certain specific embodiments thereof, it is to be understood that further modifications in both the apparatus and the methods disclosed may suggest themselves to those skilled in the art, and it is intended to cover such modifications as followed in the scope of the appended claims.

What is claimed is:

1. In a road maintenance machine for heating and working a paved surface while moving along a roadway, burner apparatus comprising:

a plurality of burner means suspended from said machine at a predetermined distance above the paved surface for heating and substantially softening the paved surface to a predetermined depth, said burner means being arranged in rows extending across said paved surface and spaced at a distance from each other to provide for alternately heating and cooling of the pavement surface as the rows of burner means move along said surface thereby allowing substantial heat penetration to said predetermined depth while maintaining the surface temperature below a predetermined limit, insulating means disposed between adjacent pairs of burner means for substantially confining the heat generated by said burners between said burners and the road surface and for providing a heat shield for protecting the portions of the burner apparatus above the insulating means, a plurality of hoods each mounted on one of the insulating means over an aperture therein for directing heat and products of combustion upward and outward away from the sides of the roadway, and fuel supply means mounted on said machine for providing said burner means with fuel.

2. In a road maintenance machine for heating and working a paved surface while moving along a roadway, burner apparatus comprising:

a self-propelled vehicle having front and rear suport wheels, a plurality of burner means suspended from said machine at a predetermined distance above the paved surface for heating and substantially softening the paved surface to a predetermined depth, said burner means being arranged in rows extending across said paved surface for alternately heating and cooling of the pavement surface as the rows of burner means move along said surface therby allowing substantial heat penetration to said predetermined depth while maintaining the surface temperature below a predetermined limit, at least a portion of said burner means being suspended in front of the front wheels of said vehicle by beam members which are telescopically attached to te vehicle to permit adjustment of the length of the beam members which project forwardly from the vehicle, and fuel supply means mounted on said machine for providing said burner means with fuel.

3. The burner apparatus of claim 2 and further comprising a support frame suspended horizontally below said boom members for supporting said rows of burner means, said support frame being suspended by cable and pulley means to allow vertical adjustment of said support frame and said rows of burner means relative to the paved surface.

4. In a road surface maintenance machine, the combination comprising:

boom members attached to the machine and extending horizontally forward in front of the machine, a frame suspended from said boom members above said road surface being vertically adjustable above said surface, a plurality of pairs of burners mounted on said frame in horizontally spaced rows below said frame and above said road surface, each row of burners being adapted to heat a strip of road surface below said row, each of said burners comprising an elongated vaporization chamber with spaced apart orifices along the bottom of the chamber, each orifice being sized to control the emission of pressurized vapor fuel out the orifices, a feeder pipe extending into the chamber and terminating in a T-shaped open-ended pipe section for injecting pressurized liquid fuel into the vaporization chamber, and a plurality of open-ended combustion cylinders each extending vertically below one of said orifices for burning the vapor fuel, the upper end of said combustion cylinder being open to provide air passages for mixing ambient air with the vapor fuel emitted from the orifices and the lower end of said combusiton cylinder being open to direct heat and products of combustion downward to the road surface, whereby, as said machine is moved along the road, a strip of the road surface transverse to the direction of travel is alternately heated as each row of burners passes over and allowed to cool between burner rows, thereby heating said surface to a predetermined depth without raising the surface temperature above a predetermined limit.

5. A road surfacing maching comprising:

a chassis frame having front and rear sets of wheels, a burner assembly suspended in front of said chassis frame at a predetermined distance above the road surface for heating a plurality of spaced apart strips along said surface transverse to the road whereby said surface is heated and softened to a predetermined depth while maintaining said surface below a predetermined temperature by moving said machine along said road surface, scarifier means adjustably attached beneath said chassis frame behind said burner assembly for raking said road surface to substantially said predetermined depth, said scarifying means comprising front and rear scarifiers provided with a plurality of rows of scarifier teeth normal to and engaging the road surface, said front scarifier being mounted behind said front set of wheels and having a plurality of said rows of scarifier teeth extending transversely across the portion of the road surface heated by said burner assembly, and said rear scarifier being mounted behind said rear set of wheels and having one of said rows of scarifier teeth extending transversely across the portions of the road surface over which the rear set of wheels have passed, and an oscillating screed mounted on said chassis frame behind said rear scarifier and having a member mounted parallel to and engaging the raked portion of the road surface, and oscillation means in communication with said member and adapted to vibrate said member to smooth and compact the raked surface of the road.

6. A general purpose road resurfacing machine including heating apparatus to heat a road surface and apparatus for reworking the road surface comprising:

a chassis frame supported by front and rear wheels and having power means for moving the chassis frame along said road surface, heating means suspended from said chassis frame above the road surface for intermittently heating a portion of the road surface as the moving chassis frame passes along the surface, universally adjustable general purpose power means fixed to the chassis frame for removably attaching beneath the chassis frame means for working the portion of the road surface softened by the heating means, and scarifier means supported and manipulated by the power means for raking the heated pavement including a plurality of teeth each biased toward the pavement by a separate spring mounted on a common frame which is supported by said adjustable power means, each of said teeth being horizontally stationary relative to said frame and independently vertically adjustable relative to the respective spring upon which said tooth is mounted.

7. The machine of claim 6 and further comprising second scarifier means attached to said chassis frame behind the rear tires for raking the portions of the pavement behind both rear tires, including a plurality of teeth mounted behind said rear tires each biased toward the pavement by a spring mounted on an adjustable framework.

8. A general purpose road resurfacing machine including heating apparatus to heat a road surface and apparatus for reworking the road surface comprising:

a chassis frame supported by front and rear wheels and having power means for moving the chassis frame along said road surface, heating means suspended from said chassis frame above the road surface for intermittently heating a portion of the road surface as the moving chassis frame passes along the surface, adjustable general purpose power means fixed to the chassis frame for removably attaching beneath the chassis frame means for working the portion of the road surface softened by the heating means, and a grooving cylinder mounted on the power means and being rotatable on an axis parallel to the road surface and having a plurality of fins spaced evenly around the circumference of said grooving cylinder each fin being mounted to project radially and extend substantially along the length of the cylinder for engaging said softened road surface to form spaced grooves extending transversely across the surface.

9. A general purpose road resurfacing maching including heating apparatus to heat a road surface and apparatus for reworking the road surface comprising:

a chassis frame supported by front and rear wheels and having power means for moving the chassis frame along said road surface, heating means suspended from said chassis frame above the road surface for intermittently heating a portion of the road surface as the moving chassis frame passes along the surface, said heating means comprising a plurality of rows of burners adjustably supported above said road surface by a framework suspended from said chassis frame and adapted to heat the portions of the road surface beneath the burner rows, each row being spaced horizontally apart from the adjacent rows to allow intermittent heating and cooling of the road surface as the machine moves along the surface, a plurality of heat shields mounted below said framework parallel to said road surface, each shield being positioned horizontally between adjacent rows of burners to substantially confine below each shield the heat and products of combusition emitted by the burners, and universally adjustable general purpose power means fixed to the chassis frame for removably attaching beneath the chassis frame means for working the portion of the road surface softened by the heating means.

10. The machine of claim 9 and further comprising a plurality of hoods each mounted on one of said heat shields above an aperture in said shield to conduct the heat and products of combustion emitted by the burners upward and outward away from the sides of the road.

11. The machine of claim 10 wherein said heat shields are rectangular insulating panels substantially abutting adjacent rows of burners and wherein each of said hoods include an inverted cone-shaped portion mounted flush with the upper surface of an insulating panel, a vertical pipe portion attached at the upper narrow end of the cone-shaped portion and an angled pipe portion connected to the upper end of the vertical pipe portion and angled to direct the heat and products of combustion away from the sides of the road.

12. In a road maintenance machine for heating and working a paved surface while moving along a roadway, burner apparatus comprising:

a plurality of spaced apart rows of burner means suspended from said machine at a predetermined distance above the paved surface for alternately applying heat to said paved surface at temperatures substantially above the burning temperature of said paved surface and allowing said surface to partially cool to maintain the temperature of said surface below said burning temperature while substantially softening the paved surface to a predetermined depth, each row of burner means comprising a fuel distribution manifold extending transversely of the roadway for substantially the width of the machine and a plurality of burners extending from the bottoms of each manifold to provide continuous heating across the path of the machine, adjacent rows of said burner means being spaced apart along the roadway a sufficient distance to provide for said alternate heating and cooling of the pavement surface as the successive burner means move along said surface thereby allowing substantial heat penetration to said predetermined depth while maintaining the surface temperature below the burning temperature of said paved surface, confining means including a confining surface spanning the space between adjacent rows of burner means for substantially confining the heat generated by said burners between said confining means and the road surface and for providing a heat shield for protecting the portions of the burner apparatus above the confining means, and fuel supply means mounted on said machine for providing said burner means with fuel.

13. In a road maintenance machine for heating and working a paved surface while moving along a roadway, burner apparatus comprising:

a plurality of burner means suspended from said machine at a predetermined distance above the paved surface for applying heat to said paved surface at temperatures substantially above the burning temperature of said paved surface and substantially softening the paved surface to a predetermined depth, said burner means being arranged in rows extending across said paved surface and spaced at a distance from each other to provide for alternately heating and cooling of the pavement surface as the rows of burner means move along said surface thereby allowing substantial heat penetration to said predetermined depth while maintaining the surface temperature below the burning temperature of said paved surface, and pressurized liquid fuel supply means mounted on said machine for providing said burner means with fuel, each burner means comprising an elongated vaporizing chamber extending transversely of the roadway and having a plurality of restrictive orifices therein at spaced intervals along the bottom of the chamber, a liquid fuel distribution manifold disposed within the vaporizing chamber along a substantial portion of the length of said chamber and insulated thereby for distributing liquid fuel to the vaporizing chamber to vaporize said liquid fuel, and a combustion chamber disposed around each orifice having an open lower end and induction openings in the upper end for inducting air into the combustion chamber.

14. The burner apparatus of claim 13 wherein said fuel supply means comprises at least one fuel tank, a distributor manifold in flow communication with said fuel tanks including a separate control station for each row of burners including valve and regulator means for controlling the pressure and quantity of fuel distributed to each of the rows of burners and a separate fuel conduit connecting the respective control station to the respective row of burners whereby each row of burners may be separately controlled.

15. In a road maintenance machine for heating and working a paved surface while moving along a roadway, burner apparatus comprising:

a plurality of burner means suspended from said machine at a predetermined distance above the paved surface for heating and substantially softening the paved surface to a predetermined depth, said burner means being arranged in rows extending across said paved surface and spaced at a distance from each other to provide for alternately heating and cooling of the pavement surface as the rows of burner means move along said surface thereby allowing substantial heat penetration to said predetermined depth while maintaining the surface temperature below a predetermined limit, and pressurized liquid fuel supply means mounted on said machine for providing said burner means with fuel, each burner means comprising an elongated vaporizing chamber extending transversely of the roadway and having a plurality of restrictive orifices therein at spaced intervals, a liquid fuel distribution manifold disposed within the vaporizing chamber and insulated thereby for distributing fuel uniformly to the vaporizing chamber, and a combustion chamber disposed around each orifice having an open lower end and induction openings in the upper end for inducting air into the combustion chamber, said vaporizing chamber and said combustion chambers being cylindrically shaped and approximately the same diameter, and said fuel distribution manifold comprising a fuel supply line entering the middle portion of the chamber and extending in opposite directions toward and terminating near the ends of the vaporizing chamber.

* * * * *